US012364344B2

(12) United States Patent
Kelley et al.

(10) Patent No.: US 12,364,344 B2
(45) Date of Patent: Jul. 22, 2025

(54) SUSTAINABLE POINT-OF-PURCHASE DISPLAY WITH RE-PULPABLE COMPONENTS

(71) Applicant: Sonoco Development, Inc., Hartsville, SC (US)

(72) Inventors: Kevin Manly Kelley, Hartsville, SC (US); David E. Rhodes, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 18/620,249

(22) Filed: Mar. 28, 2024

(65) Prior Publication Data

US 2024/0407574 A1 Dec. 12, 2024

Related U.S. Application Data

(60) Provisional application No. 63/492,699, filed on Jun. 12, 2023.

(51) Int. Cl.
*A47F 5/08* (2006.01)

(52) U.S. Cl.
CPC ..... *A47F 5/0823* (2013.01); *A47F 5/0838* (2013.01)

(58) Field of Classification Search
CPC ..... A47F 5/0823; A47F 7/28; A47F 5/0838; A47F 5/0846; A47F 5/0815; A47B 73/006; A47B 57/52; A47B 57/42; A47B 96/063; A47B 96/067; A47B 47/022; A47B 73/00
See application file for complete search history.

(56) References Cited

U.S. PATENT DOCUMENTS

| | | | |
|---|---|---|---|
| 5,340,074 | A | 8/1994 | Porcaro et al. |
| 6,536,613 | B2 | 3/2003 | Shea |
| 6,675,978 | B2 | 1/2004 | Shea |

(Continued)

FOREIGN PATENT DOCUMENTS

| | | | |
|---|---|---|---|
| CN | 213993105 | U | 8/2021 |
| EP | 0180836 | A1 | 5/1986 |
| KR | 20090055733 | A | 6/2009 |

OTHER PUBLICATIONS

International Search Report related to Application No. PCT/US2024/021970; reported on Jul. 8, 2024.

*Primary Examiner* — Ko H Chan
(74) *Attorney, Agent, or Firm* — von Briesen & Roper, s.c.

(57) ABSTRACT

A point-of-purchase (POP) display for hanging packages includes a backboard having a mounting area with a lower slot extending through the backboard. A hanger assembly includes a display rod with mounting and dispensing ends, and a mounting bracket having a horizontal bracket flange that transitions to a vertical bracket flange at a first flange bend A rod aperture is formed through the vertical bracket flange proximate the first flange bend. The horizontal bracket flange is inserted through the lower slot, and the mounting end of the display rod is inserted through the lower slot and into the rod aperture so that the dispensing end is disposed distal to the backboard so the hanging packages hang in front of the backboard. The mounting area may have an upper slot through which the vertical bracket flange may be inserted, and the backboard and the hanger assembly may be fabricated from re-pulpable materials.

20 Claims, 5 Drawing Sheets

(56) References Cited

U.S. PATENT DOCUMENTS

| | | | | |
|---|---|---|---|---|
| 7,284,671 | B1 | 10/2007 | Doscher | |
| 7,392,912 | B2 | 7/2008 | Zandt | |
| 8,348,210 | B1 * | 1/2013 | Lee | A47B 57/22 248/224.7 |
| 8,602,227 | B1 * | 12/2013 | McDonald | A47F 5/0853 211/90.01 |
| 10,971,038 | B2 | 4/2021 | Shea | |
| 2009/0166491 | A1 * | 7/2009 | Walter | A47B 96/061 248/220.31 |
| 2009/0266953 | A1 * | 10/2009 | Goldstein | A47F 5/0869 248/214 |
| 2010/0102186 | A1 * | 4/2010 | Keyvanloo | A47B 96/061 248/224.7 |
| 2022/0248875 | A1 | 8/2022 | Fenerty | |

* cited by examiner

SUSTAINABLE POINT-OF-PURCHASE DISPLAY WITH RE-PULPABLE COMPONENTS

CROSS-REFERENCE TO RELATED APPLICATION

This patent application claims the benefit of U.S. Provisional Application No. 63/492,699 filed Jun. 12, 2023, which is incorporated by reference herein.

TECHNICAL FIELD

The present disclosure relates generally to point-of-purchase (POP) displays and, more particularly, to POP displays having components fabricated from re-pulpable and/or recyclable materials as an alternative to non-recyclable materials.

BACKGROUND

A POP display is a marketing tool used by retailers to showcase and promote products at the point where customers make their purchase decisions. These displays are typically located near the checkout counters or in other high-traffic areas of the store. In recent years, there has been a growing concern about the environmental impact of components of POP displays made of non-recyclable materials, such as plastic hooks. Plastic waste is a contributor to environmental pollution and may have negative impacts on wildlife, ecosystems, and human health. Despite these concerns, many retailers continue to use POP displays with plastic components because of their low cost and durability. However, there is growing interest among consumers and retailers to transition to more sustainable materials, such as recycled plastics or biodegradable materials.

SUMMARY OF THE DISCLOSURE

In one aspect of the present disclosure, a POP display for hanging packages is disclosed. The POP display may include a backboard fabricated from a re-pulpable material, wherein the backboard has a front surface, a rear surface opposite the front surface, and a mounting area with a lower slot extending through the backboard from the front surface to the rear surface and with an upper slot disposed above the lower slot and extending through the backboard from the front surface to the rear surface. The POP display may further include a hanger assembly having a display rod fabricated from a re-pulpable material and having a mounting end and a dispensing end opposite the mounting end, and a mounting bracket fabricated from a re-pulpable material and having a horizontal bracket flange, a vertical bracket flange, and a first flange bend defining a transition between the horizontal bracket flange and the vertical bracket flange, wherein a rod aperture is formed through the vertical bracket flange proximate the first flange bend. The vertical bracket flange may be inserted through the upper slot from the rear surface to the front surface and the horizontal bracket flange may be inserted through the lower slot from the rear surface to the front surface, and the mounting end of the display rod may be inserted through the lower slot from the front surface to the rear surface and into the rod aperture so that the dispensing end of the display rod is disposed distal to the backboard.

In another aspect of the present disclosure, a hanger assembly for a POP display for hanging packages is disclosed. The backboard may have a front surface, a rear surface opposite the front surface, and a mounting area with a lower slot extending through the backboard from the front surface to the rear surface and with an upper slot disposed above the lower slot and extending through the backboard from the front surface to the rear surface. The hanger assembly may include a display rod fabricated from a re-pulpable material and having a mounting end and a dispensing end opposite the mounting end, and a mounting bracket fabricated from a re-pulpable material and having a horizontal bracket flange, a vertical bracket flange, and a first flange bend defining a transition between the horizontal bracket flange and the vertical bracket flange, wherein a rod aperture may be formed through the vertical bracket flange proximate the first flange bend. The vertical bracket flange may be inserted through the upper slot from the rear surface to the front surface and the horizontal bracket flange may be inserted through the lower slot from the rear surface to the front surface, and the mounting end of the display rod may be inserted through the lower slot from the front surface to the rear surface and into the rod aperture so that the dispensing end of the display rod is disposed distal to the backboard.

In a further aspect of the present disclosure, a POP display for hanging packages is disclosed. The POP display may include a backboard having a front surface, a rear surface opposite the front surface, and a mounting area with a lower slot extending through the backboard from the front surface to the rear surface. The POP display may further include a hanger assembly having a display rod having a mounting end and a dispensing end opposite the mounting end, and a mounting bracket having a horizontal bracket flange, a vertical bracket flange, and a first flange bend defining a transition between the horizontal bracket flange and the vertical bracket flange, wherein a rod aperture is formed through the vertical bracket flange proximate the first flange bend. The horizontal bracket flange may be inserted through the lower slot from the rear surface to the front surface, and the mounting end of the display rod may be inserted through the lower slot from the front surface to the rear surface and into the rod aperture so that the dispensing end of the display rod is disposed distal to the backboard.

Additional aspects are defined by the claims of this patent.

DETAILED DESCRIPTION

Figure 1:
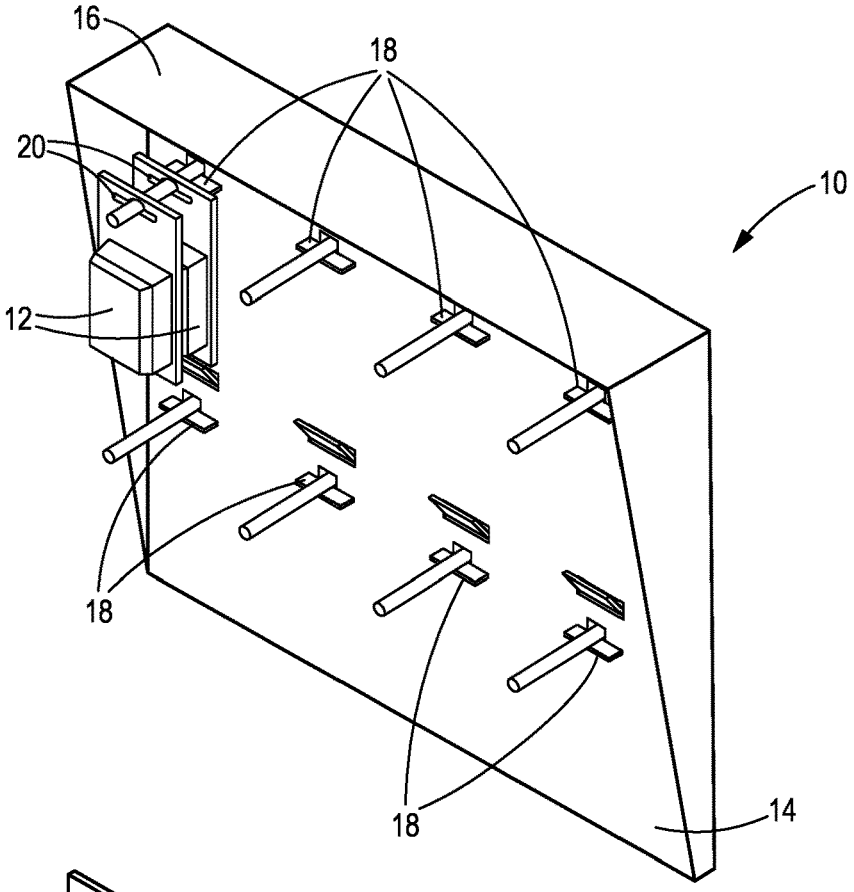
FIG. 1 is an isometric view of a POP display for hanging products fabricated from re-pulpable components in accordance with the present disclosure.

FIG. 1 illustrates an embodiment of a POP display 10 for displaying hanging packages 12 of products and fabricated from re-pulpable components in accordance with the present disclosure. The POP display 10 may include a backboard 14 with a surround 16 that are both fabricated from a heavy paper-based material such as heavy cardstock, paperboard, corrugated cardboard or the like. The backboard 14 may have a plurality of hanger assemblies 18 mounted thereto that extend from a front surface of the backboard 14 and are to be received by sombrero holes 20, for example, of the hanging packages 12 to hang the hanging packages 12 from the POP display 10.

Figure 2:
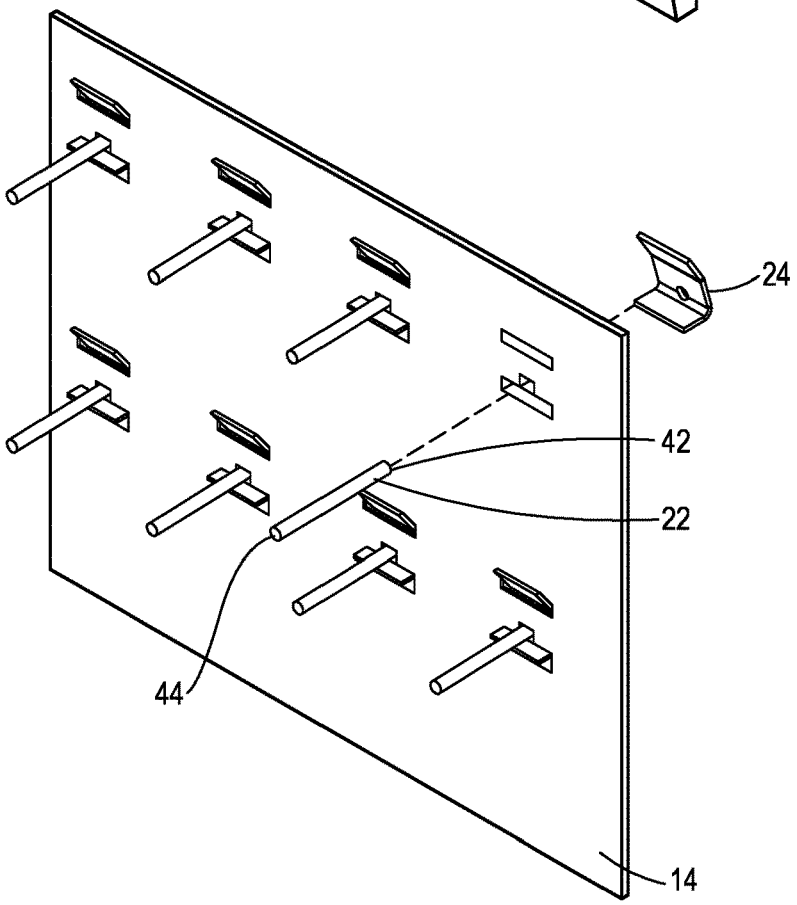
FIG. 2 is the isometric an partially exploded view of the POP display or FIG. 1 with the surround and hanging products removed and a disassembled hanger assembly in accordance with the present disclosure.

The hanger assemblies 18 may have a multi-piece construction as shown in FIG. 2. A hanger assembly 18 may include a display rod 22 that attaches to a mounting bracket 24. The display rod 22 may be a tube fabricated from layered paperboard or other re-pulpable material that is rolled into a tube and sized to be received by the sombrero holes 20 and the mounting bracket 24.

Figure 3:
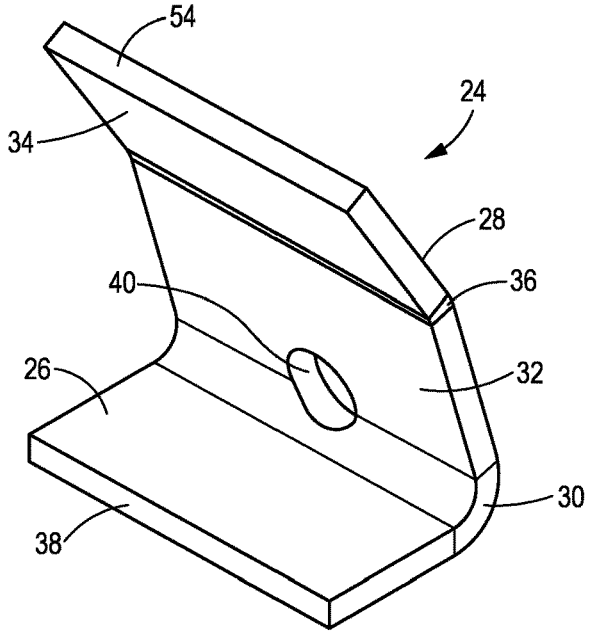
FIG. 3 is an isometric view of a mounting bracket of a hanger assembly in accordance with the present disclosure for the POP display of FIG. 1.

The mounting bracket 24 may similarly be fabricated from layered paperboard, cardstock or other re-pulpable material. An exemplary mounting bracket 24 is illustrated in the enlarged view of FIG. 3. The mounting bracket 24 may have a generally horizontal bracket flange 26, a generally vertical bracket flange 28, and a first flange bend 30 defining a transition between the bracket flanges 26, 28. In this embodiment, the vertical bracket flange 28 may be divided into a lower vertical portion 32 proximate the first flange bend 30 that transitions to an upper vertical portion 34 at a second flange bend 36. The lower vertical portion 32 may be closer to vertical relative to the horizontal bracket flange 26, whereas the upper vertical portion 34 may be rotated forward past vertical and toward a front edge 38 of the horizontal bracket flange 26, and toward a rear surface of the backboard 14 as discussed further below.

The mounting bracket 24 may also include a rod aperture 40 through the vertical bracket flange 28 proximate the first flange bend 30. The rod aperture 40 may be sized and shaped to receive and engage a mounting end 42 of the corresponding display rod 22 of the hanger assembly 18 with a dispensing end 44 of the display rod 22 disposed distally from the mounting bracket 24.

Figure 4:
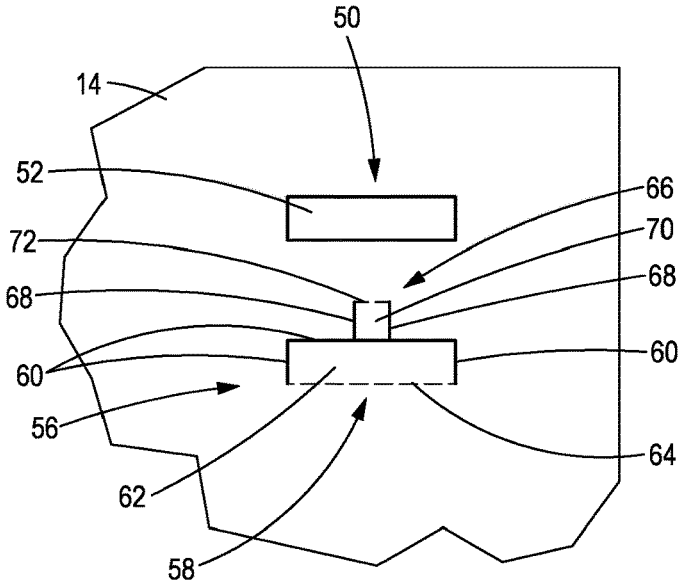
FIG. 4 is a front view of an upper right corner portion of the POP display of FIG. 1 illustrating a mounting area in accordance with the present disclosure.

The backboard 14 as shown is configured for mounting of the hanger assemblies 18 thereto. FIG. 4 illustrates an enlarged view of the upper right corner of the backboard 14 with a mounting area 50 at which one hanger assembly 18 will be installed. The mounting area 50 may includes an upper slot 52 that may be formed in the backboard 14 by die cutting or punching a rectangular area out of the backboard 14. The upper slot 52 may be sized and shaped to receive an upper edge 54 (FIG. 3) and the upper vertical portion 34 of the vertical bracket flange 28 during installation. A lower slot 56 may be formed below the upper slot 52. In the illustrated embodiment, the portions of backboard 14 forming the lower slot 56 may be only partially detached from the backboard 14. A lower flange slot 58 may be formed by lower flange slot cut lines 60 through the backboard 14 and have a lower flange flap 62 that can rotate about a lower flange slot score line 64 formed by creasing or scoring the corresponding portion of the backboard 14. A display rod slot 66 may be formed by display rod slot cut lines 68 through the backboard 14 and have a display rod flap 70 that can rotate about a display rod slot score line 72 formed by creasing or scoring the corresponding portion of the backboard 14. The lower flange slot 58 and the display rod slot 66 of the lower slot 56 may be sized and shaped to receive the horizontal bracket flange 26 and the display rod 22, respectively.

Installation of a hanger assembly 18 at a mounting area 50 of the backboard 14 may begin with the upper edge 54 and the upper vertical portion 34 of the mounting bracket 24 being inserted from the rear surface of the backboard 14 through the upper slot 52. With the upper vertical portion 34 inserted, the front edge 38 and the horizontal bracket flange 26 may be pressed through the lower flange slot 58 and cause the lower flange flap 62 to rotate forward about the lower flange slot score line 64. Resiliency of the material of the backboard 14 will tend to rotate the lower flange flap 62 back toward the lower flange slot 58, and thereby apply force to the horizontal bracket flange 26 and create friction and some resistive force against the horizontal bracket flange 26 sliding backward out of the lower flange slot 58. With the mounting bracket 24 installed, the mounting end 42 of the display rod 22 may be pressed through the display rod slot 66 from the front surface of the backboard 14 and into the rod aperture 40 of the mounting bracket 24. The mounting end 42 of the display rod 22 may cause the display rod flap 70 to rotate rearward about the display rod slot score line 72, with the display rod flap 70 creating friction and some resistive force against the display rod 22 sliding forward out of the display rod slot 66. The display rod 22 and the rod aperture 40 may be sized and shaped so that the display rod 22 may be press fit into the rod aperture 40 and retained therein by friction sufficient to prevent the display rod 22 from being easily pulled out of the rod aperture 40. If necessary, adhesive, clips, tacks, brads or other fastening mechanisms may be used to secure the display rod 22 to the mounting bracket 24.

With the hanger assembly 18 mounted on the backboard 14, multiple hanging packages 12 of the product may be loaded onto the hanger assembly 18 by sliding the sombrero holes 20 of the hanging packages 12 over the dispensing end 44 of the display rod 22. The display rod 22 functions as a cantilever that is mounted to the vertical bracket flange 28 and supported by the horizontal bracket flange 26. The weight of the hanging packages 12 will press the vertical bracket flange 28 into the rear surface of the backboard 14 to support the hanging packages 12 and prevent the display rod 22 from rotating downward.

Figure 5:
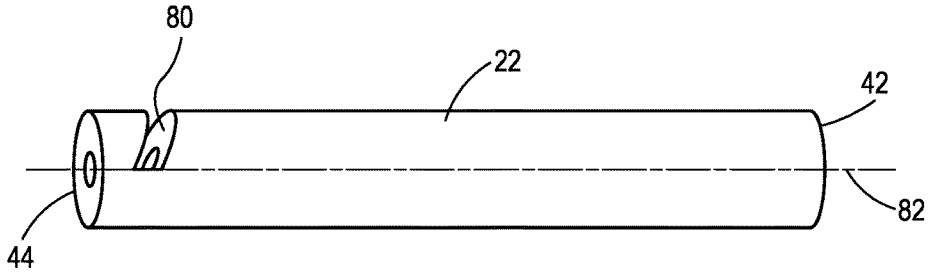
FIG. 5 is an isometric view of a display rod of the POP display of FIG. 1 with a package retention notch proximate a dispensing end.
Figure 6:
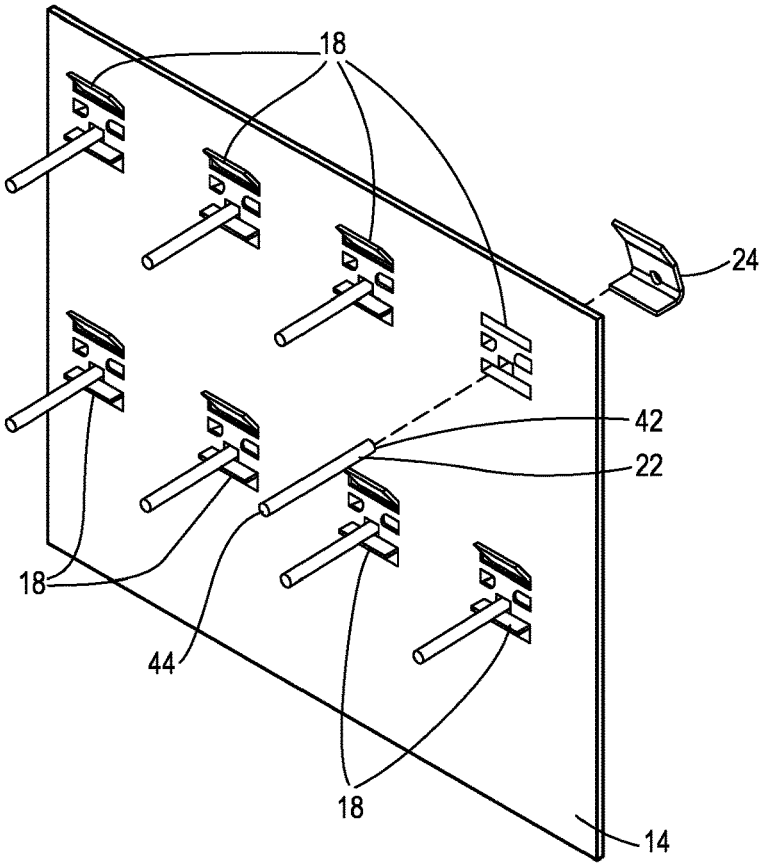
FIG. 6 is an isometric view of an alternative embodiment of POP display for hanging products fabricated from re-pulpable components in accordance with the present disclosure.
Figure 7:
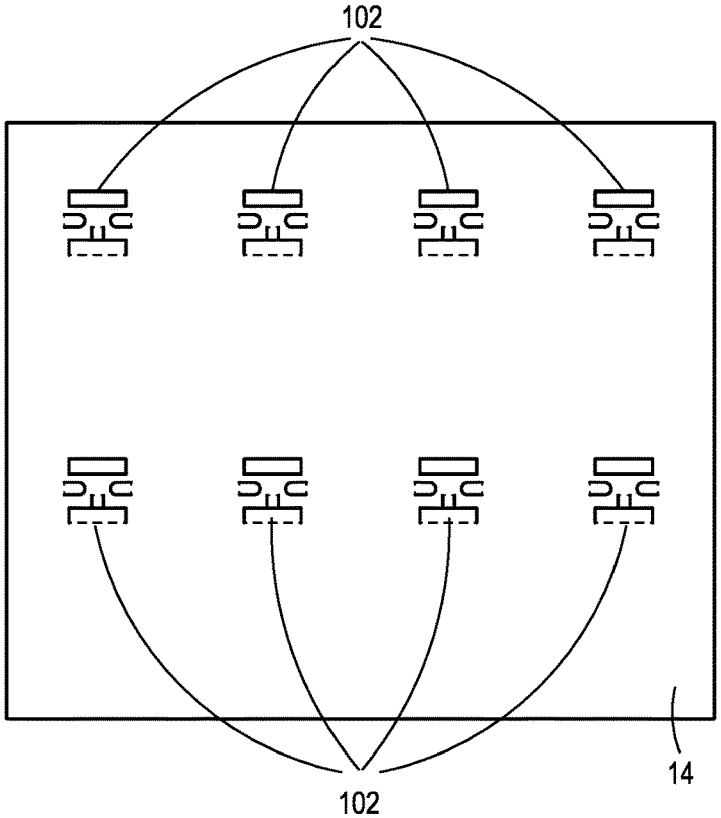
FIG. 7 is a front view of a backboard of the POP display of FIG. 6.
Figure 8:
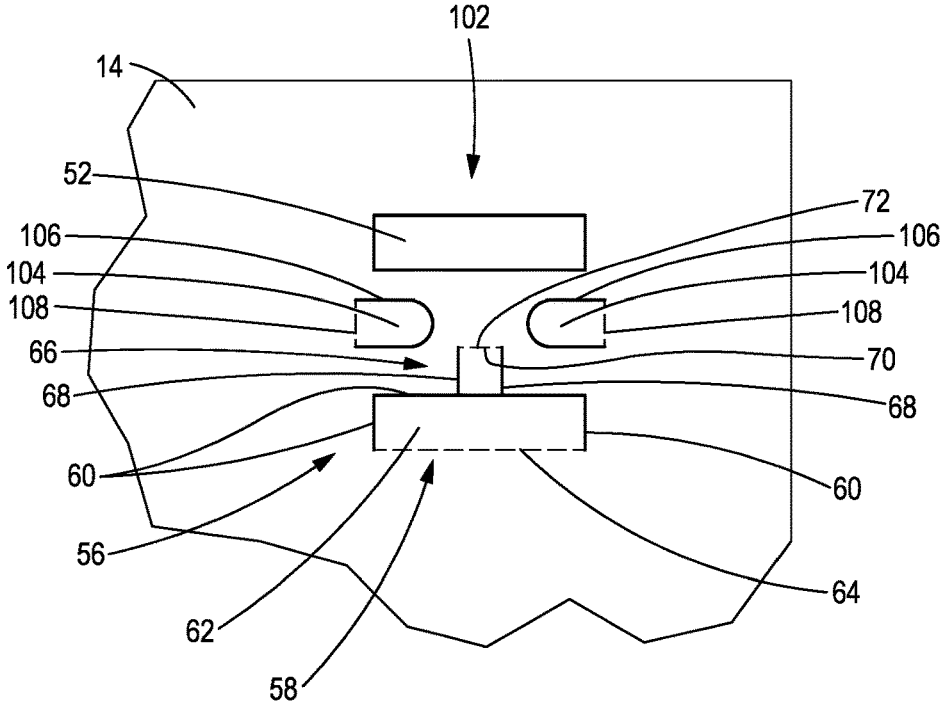
FIG. 8 is a front view of an upper right corner portion of the POP display of FIG. 6 illustrating a mounting area in accordance with the present disclosure.
Figure 9:
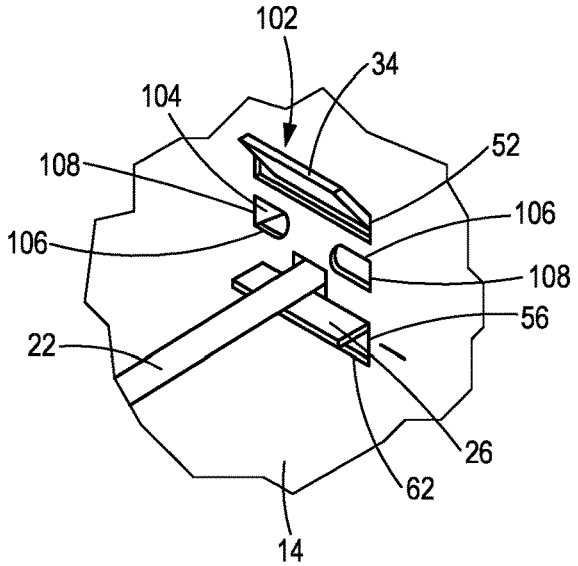
FIG. 9 is an enlarged isometric view of a front surface of the backboard of the POP display of FIG. 6 with a hangar assembly installed at one of the mounting areas.

Those skilled in the art will understand that the angle between the horizontal bracket flange 26 and the vertical bracket flange 28 formed at the first flange bend 30 may be varied to orient the display rod 22 such that the hanging packages 12 will not slide off the display rod 22. In some implementations, the angle between the bracket flanges 26, 28 may be set so that the display rod 22 extends approximately horizontally or slightly upward from the backboard 14. In other implementations, the bracket flanges 26, 28 may be configured such that the display rod 22 is angled upward as the display rod 22 extends from the backboard 14 so that gravity will tend to slide the hanging packages 12 toward the backboard 14. In still further implementations, it may be desired to have the display rod 22 angled downward so that gravity may cause the hanging packages 12 to feed away from the backboard 14 and toward the dispensing end 44 of the display rod 22. In such implementations, the bracket flanges 26, 28 are configured with a greater angle therebetween so that the horizontal bracket flange 26 is angled downward. To prevent the hanging packages 12 from freely sliding off the display rod 22, a package retention notch 80 as shown in FIG. 5 may be formed in the display rod 22 proximate the dispensing end 44. The package retention notch 80 may be angled away from the dispensing end 44 as the package retention notch 80 extends away from a rod longitudinal axis 82 of the display rod 22 to match the downward angle of the display rod 22 when the hanger assembly 18 is installed on the backboard 14 so that the package retention notch 80 extends approximately vertically to align with the orientation of the hanging packages 12. As the hanging packages 12 slide toward the dispensing end 44, the forwardmost hanging package 12 will drop into the package retention notch 80 to stop the hanging package 12 before it falls off the dispensing end 44. A customer or employee may remove the hanging package by lifting it out of the package retention notch 80 and off the dispensing end 44, after which the next forwardmost hanging package 12 will be caught by the package retention notch 80.

Figure 10:
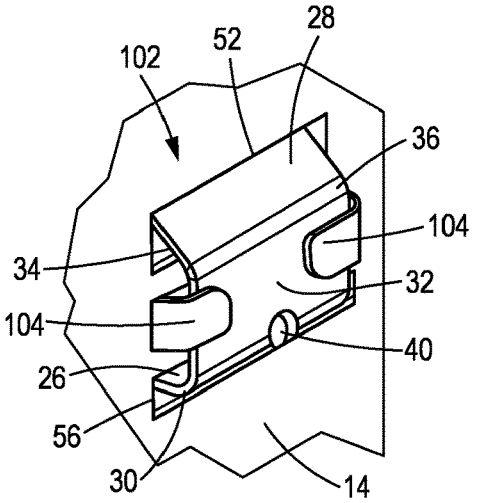
FIG. 10 is an enlarged isometric view of a rear surface of the backboard of the POP display of FIG. 6 with the hangar assembly installed at one of the mounting areas.

FIGS. 6-10 illustrate an alternative embodiment of a POP display 100 that provides additional retention of the hanger assemblies 18. In the drawing figures and the following discussion, components of the POP display 100 that correspond to components of the POP display 100 discussed above are identified with the same reference numerals. In this embodiment, the hanger assemblies 18 have the same general configurations as described above. However, the backboard 14 is configured with mounting areas 102 that are configured to provide additional structures for engaging the mounting brackets 24 when the hanger assemblies 18 are installed. Referring to the front view of the backboard 14 in FIG. 7 and the enlarged portion of the upper right corner of the backboard in FIG. 8, the mounting area 102 includes the upper slot 52 and the lower slot 56 as illustrated and described above. In addition to the slots 52, 56, a pair of retention tabs 104 are formed in the backboard 14 between the slots 52, 56. The retention tabs 104 may be formed by retention tab cut lines 106 through the backboard 14, and are able to rotate about retention tab score lines 108 formed by creasing or scoring the corresponding portions of the backboard 14. When the slots 52, 56 and the retention tabs 104 of the mounting areas 102 are formed in the backboard 14, the retention tabs 104 may be punched through the rear surface of the backboard 14 (FIG. 9) and shaped to wrap around corresponding side edges of the vertical bracket flange 28 as shown in FIG. 10. When the mounting bracket 24 is installed on the backboard 14, the vertical bracket flange 28 is inserted between the retention tabs 104. Installed in this way, the retention tabs 104 provide additional resistance for the mounting bracket 24 against forces tending to push the mounting bracket 24 away from the rear surface of the backboard 14, including forces caused by the weight of the hanging packages 12 on the display rod 22.

Figure 11:
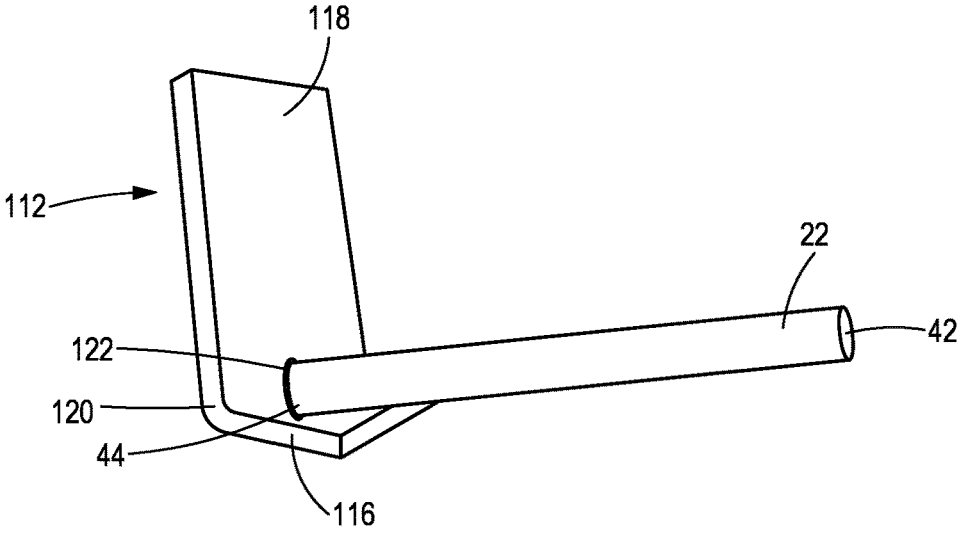
FIG. 11 is a photographic perspective view of an alternative embodiment of a hanger assembly for a POP display in accordance with the present disclosure.
Figure 12:
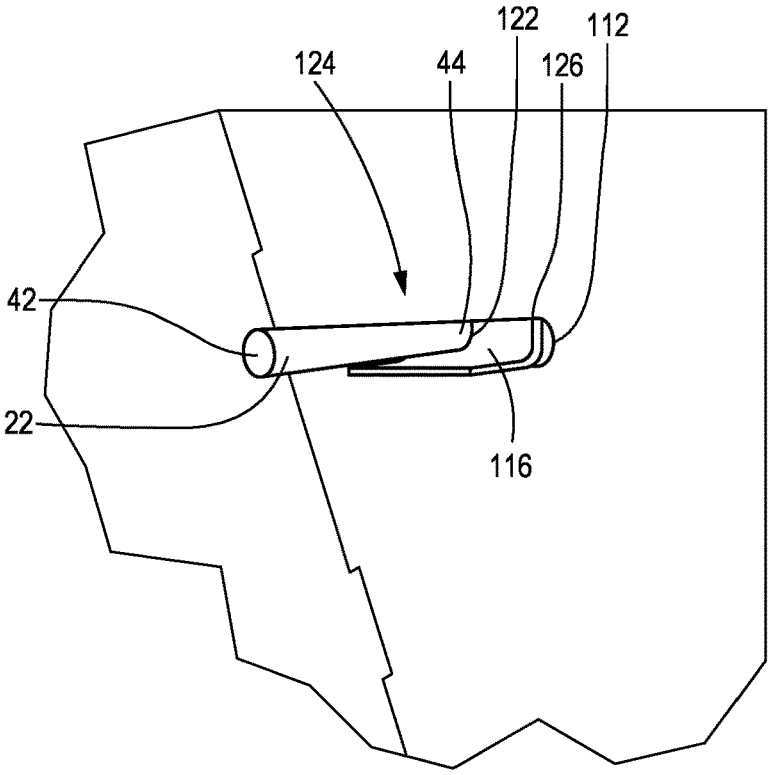
FIG. 12 is a photographic front view of a portion of a POP display with the hanger assembly of FIG. 11.

FIGS. 11 and 12 illustrate a further embodiment of a POP display 110 with an alternative configuration of a hanger assembly 112. As shown in FIG. 11, the hanger assembly 112 may include the display rod 22 as described above and an alternative design for a mounting bracket 114. The mounting bracket 114 may similarly be fabricated from layered paperboard, cardstock or other re-pulpable material. The mounting bracket 114 may have a generally horizontal bracket flange 116, a generally vertical bracket flange 118, and a single flange bend 120 defining a transition between the bracket flanges 116, 118. In this embodiment, the vertical bracket flange 118 is generally planar and does not have an additional bend dividing the vertical bracket flange 118 into lower and upper vertical portions. The mounting bracket 114 also includes a rod aperture 122 through the vertical bracket flange 118 proximate the flange bend 120. The rod aperture 122 may be sized and shaped to receive and engage the mounting end 42 of the corresponding display rod 22 of the hanger assembly 112 with the dispensing end 44 of the display rod 22 disposed distally from the mounting bracket 114.

As shown in FIG. 12, the backboard 14 of the POP display 110 is configured with a plurality of mounting areas 124 at which hanger assemblies 112 are installed. Each mounting area 124 may have only a lower slot 126 that is configured to receive the horizontal bracket flange 116 in a similar manner as the lower slot 56. The portion of backboard 14 forming the lower slot 126 may be either partially detached or fully detached from the backboard 14 depending on what engagement may be necessary to support the hanging packages 12 on the display rod 22.

With the hanger assembly 112 mounted on the backboard 14, multiple hanging packages 12 of the product may be loaded onto the hanger assembly 112 by sliding the sombrero holes 20 of the hanging packages 12 over the dispensing end 44 of the display rod 22. The display rod 22 functions as a cantilever that is mounted to the vertical bracket flange 118 and supported by the horizontal bracket flange 116. The weight of the hanging packages 12 will press the vertical bracket flange 118 into the rear surface of the backboard 14 to support the hanging packages 12 and prevent the display rod 22 from rotating downward. The angle between the horizontal bracket flange 116 and the vertical bracket flange 118 formed at the flange bend 120 may be varied to orient the display rod 22 approximately horizontal, or angled upward or downward in a similar manner as described above for the hanger assembly 18 depending on the requirements for a particular implementation of the POP display 110. When the display rod 22 is angled downward, the package retention notch 80 may be provided in the display rod 22 to prevent the hanging packages 12 from sliding off the display rod 22.

INDUSTRIAL APPLICABILITY

The POP displays 10, 100, 110 in accordance with the present disclosure are fabricated from sustainable materials that may be re-pulpable for use in future paper products. The design is intended to be versatile and adaptable to a wide range of products, and it is also intended to be easy to assemble and disassemble. Overall, the present disclosure seeks to provide a sustainable alternative to traditional POP displays incorporating plastic hangers and other non-recyclable components, while still offering the same marketing benefits for retailers and visibility for products. By using recyclable, re-pulpable or biodegradable materials, the entire POP displays 10, 100, 110 can be tossed in a recycle bin after use without the necessity of picking out non-recyclable components such as the plastic pegs use with previously known POP displays, thereby reducing the environmental impact of the retail marketing devices.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A point-of-purchase (POP) display for hanging packages comprising:

a backboard fabricated from a re-pulpable material, wherein the backboard has a front surface, a rear surface opposite the front surface, and a mounting area with a lower slot extending through the backboard from the front surface to the rear surface and with an upper slot disposed above the lower slot and extending through the backboard from the front surface to the rear surface; and a hanger assembly comprising:

a display rod fabricated from a re-pulpable material and having a mounting end and a dispensing end opposite the mounting end, and a mounting bracket fabricated from a re-pulpable material and having a horizontal bracket flange, a vertical bracket flange, and a first flange bend defining a transition between the horizontal bracket flange and the vertical bracket flange, wherein a rod aperture is formed through the vertical bracket flange proximate the first flange bend, wherein the vertical bracket flange is inserted through the upper slot from the rear surface to the front surface and the horizontal bracket flange is inserted through the lower slot from the rear surface to the front surface, and the mounting end of the display rod is inserted through the lower slot from the front surface to the rear surface and into the rod aperture so that the dispensing end of the display rod is disposed distal to the backboard.

2. The POP display of claim 1, wherein the vertical bracket flange comprises:

a lower vertical portion proximate the first flange bend;

an upper vertical portion; and a second flange bend forming a transition from the lower vertical portion to the upper vertical portion.

3. The POP display of claim 2, wherein the upper vertical portion is rotated forward past vertical and toward a front edge of the horizontal bracket flange.

4. The POP display of claim 2, wherein the upper vertical portion is inserted through the upper slot.

5. The POP display of claim 1, wherein the horizontal bracket flange is oriented relative to the vertical bracket flange so that the display rod is angled upward relative to horizontal as the display rod extends away from the backboard and the mounting bracket.

6. The POP display of claim 1, wherein the horizontal bracket flange is oriented relative to the vertical bracket flange so that the display rod is angled downward relative to horizontal as the display rod extends away from the backboard and the mounting bracket.

7. The POP display of claim 6, wherein the display rod has a package retention notch formed in the display rod proximate the dispensing end.

8. The POP display of claim 1, wherein the lower slot comprises a lower flange flap disposed within the lower slot and connected to the backboard by a lower flange slot score line, wherein the lower flange flap is rotated forward about the lower flange slot score line when the horizontal bracket flange is inserted through the lower slot.

9. The POP display of claim 1, wherein the mounting area comprises a pair of retention tabs formed in the backboard between the upper slot and the lower slot and connected to the backboard by retention tab score lines, wherein the pair of retention tabs are punched through the rear surface of the backboard and engage corresponding side edges of the vertical bracket flange when the mounting bracket is installed on the backboard.

10. A hanger assembly for a point-of-purchase (POP) display for hanging packages, the POP display having a backboard fabricated from a re-pulpable material, wherein the backboard has a front surface, a rear surface opposite the front surface, and a mounting area with a lower slot extending through the backboard from the front surface to the rear surface and with an upper slot disposed above the lower slot and extending through the backboard from the front surface to the rear surface, the hanger assembly comprising:

a display rod fabricated from a re-pulpable material and having a mounting end and a dispensing end opposite the mounting end; and a mounting bracket fabricated from a re-pulpable material and having a horizontal bracket flange, a vertical bracket flange, and a first flange bend defining a transition between the horizontal bracket flange and the vertical bracket flange, wherein a rod aperture is formed through the vertical bracket flange proximate the first flange bend, wherein the vertical bracket flange is inserted through the upper slot from the rear surface to the front surface and the horizontal bracket flange is inserted through the lower slot from the rear surface to the front surface, and the mounting end of the display rod is inserted through the lower slot from the front surface to the rear surface and into the rod aperture so that the dispensing end of the display rod is disposed distal to the backboard.

11. The hanger assembly of claim 10, wherein the vertical bracket flange comprises:

a lower vertical portion proximate the first flange bend;

an upper vertical portion; and a second flange bend forming a transition from the lower vertical portion to the upper vertical portion.

12. The hanger assembly of claim 11, wherein the upper vertical portion is rotated forward past vertical and toward a front edge of the horizontal bracket flange.

13. The hanger assembly of claim 10, wherein the horizontal bracket flange is oriented relative to the vertical bracket flange so that the display rod is angled upward relative to horizontal as the display rod extends away from the backboard and the mounting bracket when the hanger assembly is mounted to the backboard at the mounting area.

14. The hanger assembly of claim 10, wherein the horizontal bracket flange is oriented relative to the vertical bracket flange so that the display rod is angled downward relative to horizontal as the display rod extends away from the backboard and the mounting bracket when the hanger assembly is mounted to the backboard at the mounting area.

15. The hanger assembly of claim 14, wherein the display rod has a package retention notch formed in the display rod proximate the dispensing end.

16. A point-of-purchase (POP) display for hanging packages comprising:

a backboard having a front surface, a rear surface opposite the front surface, and a mounting area with a lower slot extending through the backboard from the front surface to the rear surface; and a hanger assembly comprising:

a display rod having a mounting end and a dispensing end opposite the mounting end, and a mounting bracket having a horizontal bracket flange, a vertical bracket flange, and a first flange bend defining a transition between the horizontal bracket flange and the vertical bracket flange, wherein the vertical bracket flange extends upward from the first flange bend and does not extend downward from the first flange bend below the horizontal bracket flange, and wherein a rod aperture is formed through the vertical bracket flange proximate the first flange bend, wherein the horizontal bracket flange is inserted through the lower slot from the rear surface to the front surface, and the mounting end of the display rod is inserted through the lower slot from the front surface to the rear surface and into the rod aperture so that the dispensing end of the display rod is disposed distal to the backboard.

17. The POP display of claim 16, wherein the mounting area includes an upper slot disposed above the lower slot and extending through the backboard from the front surface to the rear surface, and wherein the vertical bracket flange comprises:

a lower vertical portion proximate the first flange bend, an upper vertical portion, and a second flange bend forming a transition from the lower vertical portion to the upper vertical portion, wherein the upper vertical portion of the vertical bracket flange is inserted through the upper slot from the rear surface to the front surface.

18. The POP display of claim 16, wherein the horizontal bracket flange is oriented relative to the vertical bracket flange so that the display rod is angled upward relative to horizontal as the display rod extends away from the backboard and the mounting bracket.

19. The POP display of claim 16, wherein the horizontal bracket flange is oriented relative to the vertical bracket flange so that the display rod is angled downward relative to horizontal as the display rod extends away from the backboard and the mounting bracket.

20. The POP display of claim 19, wherein the display rod has a package retention notch formed in the display rod proximate the dispensing end.

* * * * *